US005215121A

United States Patent [19]

Michl

[11] Patent Number: 5,215,121

[45] Date of Patent: Jun. 1, 1993

[54] TUBE SEPARATOR

[75] Inventor: Peter Michl, Wittislingen, Fed. Rep. of Germany

[73] Assignee: Prufer, Munich, Fed. Rep. of Germany

[21] Appl. No.: 819,849

[22] Filed: Jan. 13, 1992

[30] Foreign Application Priority Data

Jan. 16, 1991 [DE] Fed. Rep. of Germany ..... 4101114

[51] Int. Cl.[5] ..... F16K 31/122

[52] U.S. Cl. ..... 137/614.2; 137/488; 251/315

[58] Field of Search ..... 137/614.2, 488, 487.5; 251/315, 62

[56] References Cited

U.S. PATENT DOCUMENTS

| | | | |
|---|---|---|---|
| 3,104,962 | 9/1963 | Pearson | 251/315 X |
| 3,151,837 | 10/1964 | Bentley | 251/315 X |
| 3,375,845 | 4/1968 | Behm | 137/614.2 X |
| 4,745,946 | 5/1988 | Kern | 137/488 X |
| 4,800,918 | 1/1989 | Arens | 137/488 |
| 4,972,872 | 11/1990 | Hunt | 137/487.5 |

*Primary Examiner*—Alan Cohan

*Attorney, Agent, or Firm*—Donald Brown

[57] ABSTRACT

A tube separator comprises an inlet and an outlet to define a flow direction from the inlet to the outlet, shut-off means arranged between the inlet and the outlet for connecting the inlet with the outlet in a first position thereof and for disconnecting the inlet from the outlet in a second position thereof, control means for operating the shut-off means and a non-return valve at the outlet for blocking or allowing fluid flow from the inlet to the outlet. The shut-off means comprises a shut-off member being arranged in the shut-off means for rotation around an axis perpendicular to the flow direction from a first rotational position to a second rotational position thereof, and a bore is provided in the shut-off member for connecting the inlet with the outlet in the first rotational position and for disconnecting the inlet from the outlet in the second rotational position.

5 Claims, 9 Drawing Sheets

TUBE SEPARATOR

BACKGROUND OF THE INVENTION

The invention relates to a tube separator for use in particular in water lines to shut-off the water line.

Such a tube separator is disclosed in German Patent Specification 32 47 325. The function of this known tube separator is based on a pressure comparison between the inlet side and the outlet side of the tube separator; in dependence on the pressure conditions a tube separator piston or a piston separator tube changes position by the action of the water pressure into an open position or for separation by action of the inlet pressure drop through a spring which directly acts upon the tube separator piston or on the piston separator tube into the shut-off or respective operating position. This requires relatively large displacements of the piston into the respective end positions. Further, the sliding surfaces must be of good quality in order to ensure the tightness between the tube separator piston and the tube separator housing. The continuous exchange of pressure water at the tube separator leads to deposits on the sliding surfaces in the piston chamber which will cause wear of the seal members. Moreover, relatively large springs are required for lifting the tube separator piston back up. If this restoring spring does not operate properly, the tube separator piston can not be switched back into the shut-off position.

The german Utility Model 98 05 206 discloses a tube separator which consists of two conventional check valves and two modified conventional backflow preventing devices arranged between the check valves in a cross piece vertically above each other. The essential element of the upper backflow preventer is a ball which is pressed into a valve seat by the pressure of the water flowing through the tube separator in the open position thereof and which drops off from the valve seat on interruption of the flow. This upper backflow preventer functions to vent the cross piece in the shut-off position. The lower backflow preventer comprises a ball which is pressed by the action of the passing water onto a valve seat against a spring force and pressed away from the valve seat by the spring on termination of the flow. This lower backflow preventer serves to drain water from the cross piece is the shut-off position. This known tube separator does not meet the actual legal requirements regarding the safety of operation; further, its function is very sensitive to the proper position of the balls in the valve seat which can easily be affected e.g. by pollutions or deposits.

OBJECTS OF THE INVENTION

It is an object of the invention to provide an improved tube separator in which the above-mentioned drawbacks are avoided.

It is a further object to provide a tube separator having an improved operational reliability.

SUMMARY OF THE INVENTION

In order to achieve the above-mentioned objects the invention provides a tube separator comprising an inlet and an outlet to define a flow direction from said inlet to said outlet, shut-off means arranged between said inlet and said outlet, a shut-off member being arranged in said shut-off means for rotation around an axis perpendicular to said flow direction from a first rotational position to a second rotational position, a bore in said shut-off member for connecting said inlet with said outlet in said first rotational position and for disconnecting said inlet from said outlet in said second rotational position, control means for operating said shut-off means and a non-return valve at said outlet for blocking or allowing fluid flow from said inlet to said outlet.

BRIEF DESCRIPTION OF THE DRAWINGS

Further advantages, features and objects of the invention will stand out from the following description of exemplary embodiments with reference to the drawings, wherein.

DESCRIPTION OF PREFERRED EMBODIMENTS

Figure 1:
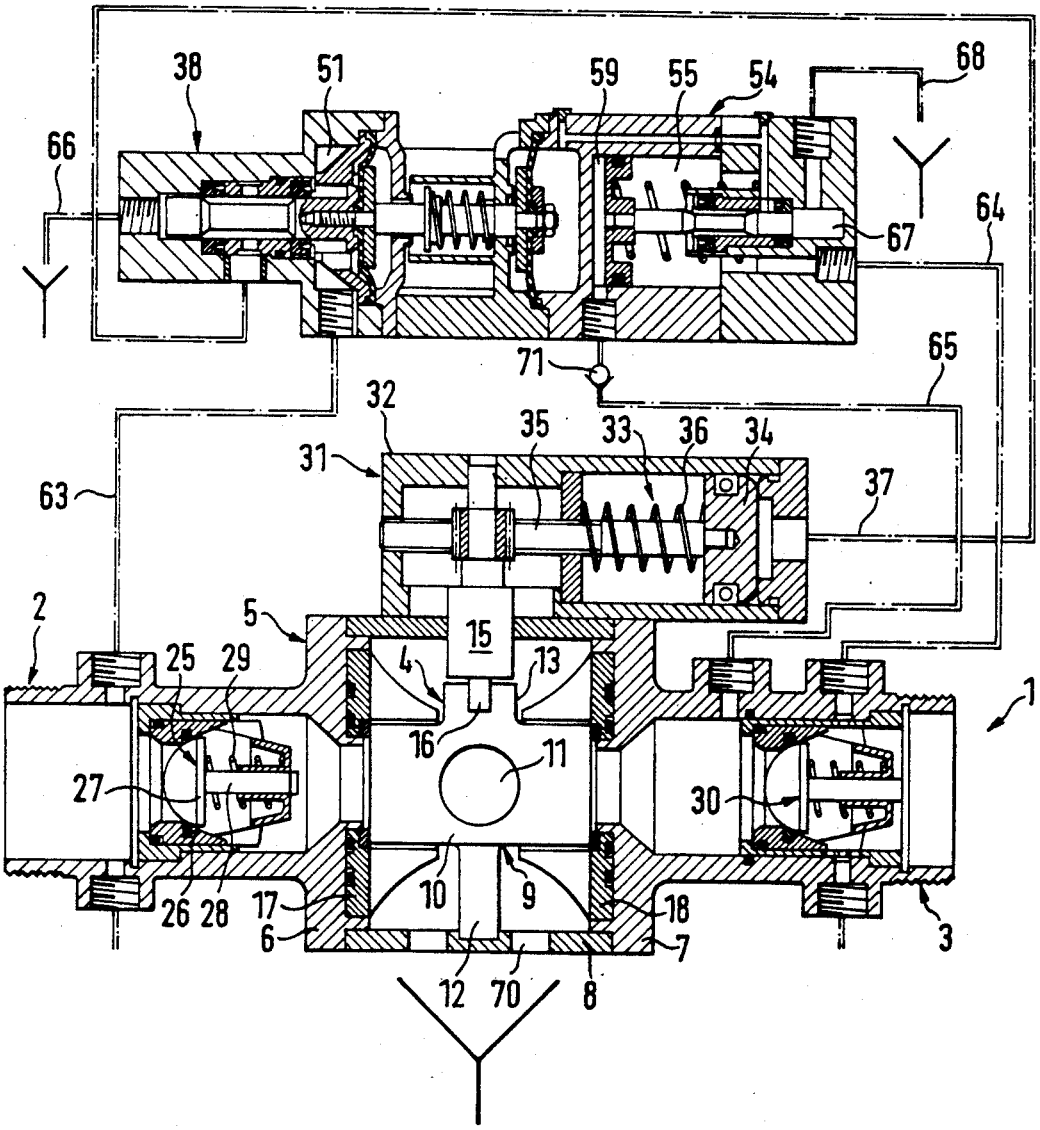
FIG. 1 is a sectional view of a first embodiment of the tube separator in shut-off position.

The tube separator 1 comprises an inlet which is formed by an inlet connection piece 2 for connection with an inlet tube as well as an outlet which is formed by an outlet connection piece 3 for connection with an outlet tube. A shut-off means 4 is arranged between the inlet connection piece 2 and the outlet connection piece 3. The shut-off means 4 comprises a housing 5 which is formed by an inlet flange 6 connected to said inlet connection piece, a flange 7 spaced from flange 6 and connected with said outlet connection piece 3, and a cylindrical tubular piece 8 held between the flanges 6, 7. A plug of a cock 9 is provided in the interior of the housing and comprises a cylindrical portion 10 having an axis which extends perpendicular to the axis of the tubular piece 8. A bore 11 extending perpendicularly to the axis of the cylindrical portion 10 is provided in said cylindrical portion 10. The plug 9 has a journal 12 extending from the lower end of the cylindrical portion 10 and engaging a counterbore provided in the bottom region of the tubular piece 8 to form a pivot bearing. At its top side opposite to said journal 12 the cylindrical portion 10 comprises a cylindrical projection 13 having a slot or groove 14 extending transversely to the axis of the journal 12 and having its center on said axis. A bore is provided at a position of the tubular piece 8 opposite to the counterbore receiving the journal 12 and a driving shaft 15 is passed through the bore. The driving shaft 15 is in engagement with a driving piece 16 engaging the groove 14 and extends outwardly through the housing to a gearing.

Figure 2:
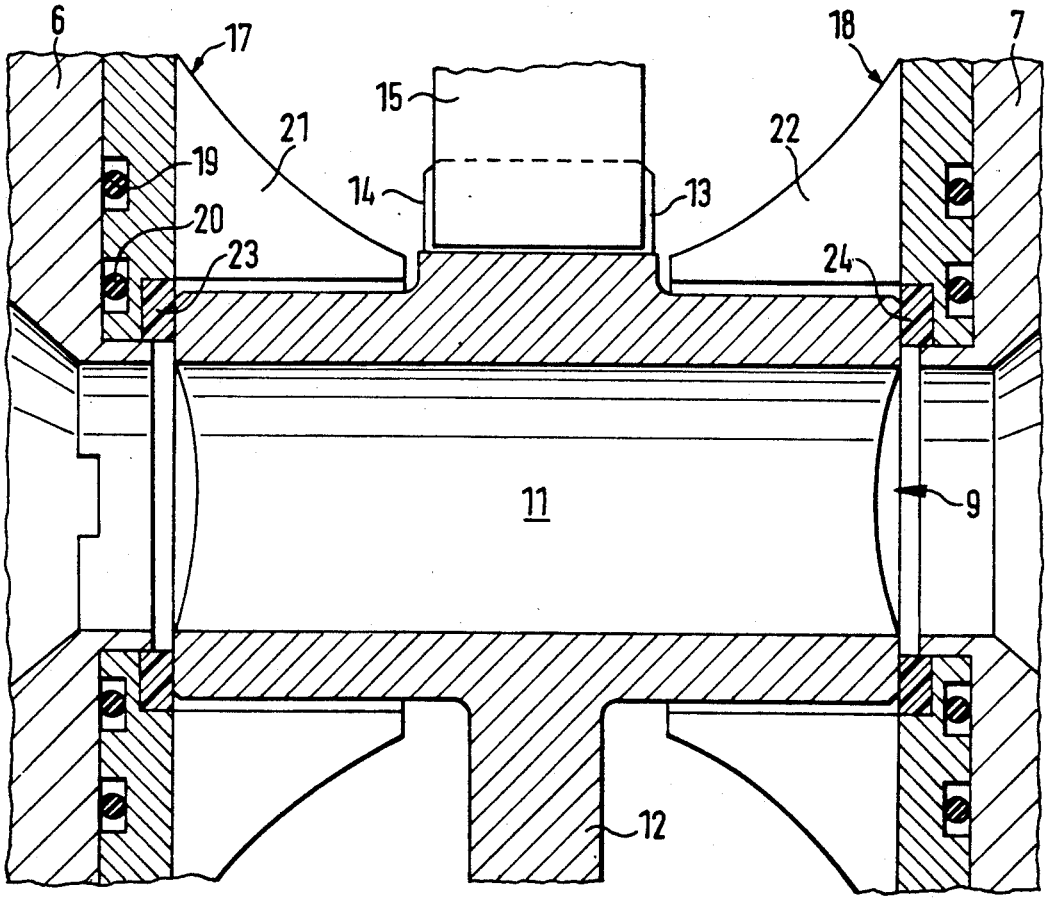
FIG. 2 is an enlarged representation of the shut-off means.

Circular recesses are provided in the facing surfaces of the flanges 6, 7 coaxially with the tube ends. Respective thrust members 17, 18 are inserted into these recesses. At the surface thereof facing the flanges a seal is obtained by means of sealing rings. Each thrust member comprises, as best shown in FIG. 2, a hollow cylindrical wall portion 21 and 22, resp., coaxially with the axis of rotation of the plug 9. The region of the wall portions 21, 22 which engages the wall of the plug 9 is provided with coatings 23, 24 which are preferably formed of PTFE material and provide a seal between the inlet connection piece and the outlet connection piece, resp., on the one hand and the bore 11 of the plug 9 on the other hand. The thrust members are freely movable for compensation of tolerances. Preferably spring members may be provided between the flanges 6, 7 and the adjacent thrust members 17, 18 to press the thrust members forcibly against the plug 9 to assure tightness. The spring members may be rubber elastic or other kinds of springs such as disk springs.

A valve 25 is provided in the inlet connection piece upstream of the shut-off means 4. The valve 25 comprises a valve seat 26 and a valve shaft 28 with a valve body 27 cooperating with the valve seat 26. The valve is biased into the closed position shown in FIG. 1 by means of a compression spring. A corresponding valve 30 is provided in the outlet connection piece 3 downstream of the plug 9. The valve 30 is also biased towards the inlet side into the closed position by means of a spring as shown in FIG. 1.

In this manner an input pressure zone is formed in the inlet region upstream of valve 25, an output pressure zone is formed in the outlet region downstream of the valve 30 and an intermediate pressure zone is formed in the region between the two valves 25 and 30.

The driving shaft 15 passing outwardly through the tubular piece 8 belongs to a gearing unit 31 which comprises a housing 32 connected to the housing 5 and a piston-cylinder means 33 arranged in the housing 32. The piston-cylinder means 33 comprises a cylinder chamber and a piston valve which is reciprocally movable therein and connected with a rack 35. A compression spring 36 biases the piston valve and thus the rack into the retracted position shown in FIG. 1. The rack engages a toothed wheel rim portion of the driving shaft 15 directly or through an intermediate step-up gear. The step-up ratio is selected as a function of the size of the tube separator and of the resulting actuation force for the plug 9. The cylinder chamber is connected with a control line 37 at the side of the piston valve 34 opposite to the compression spring.

A control unit 38 which is per se known from document DE 35 20 250 C controls the gearing unit 31. The control unit 38 is formed as a pressure difference valve and comprises a housing 39 having therein a piston valve 40 which is rigidly connected with a diaphragm 41, a diaphragm disk 42, a connecting piston 43, a diaphragm 44 with associated diaphragm disk 45 and a disk 46. An upper diaphragm chamber 47 opens to the atmosphere through a bore 48 and a free passage 49. A spring 50 is prestressed to a pressure of 0.55 bar and urges the diaphragms 41, 44 as well as the piston valve 34 and the connecting piston 43 into the shut-off position shown in FIGS. 1 and 3 in case of a pressure balance between a lower diaphragm chamber 51 and an upper pressure chamber 52.

Vent slots 53 for pressure compensation or equalisation are provided below the diaphragm 44. In case of a rupture of the diaphragm this provides a direct connection to the atmosphere.

The control unit 38 comprises an associated actuating unit 54. This unit is formed as a 4-direction-2-position valve and comprises a spool valve chamber 55 wherein a spool valve 57 provided with a seal 56 is reciprocally movable. A connection bore 58 in the spool valve connects the upper spool valve chamber 55 with a lower spool valve chamber 59.

Figure 3:
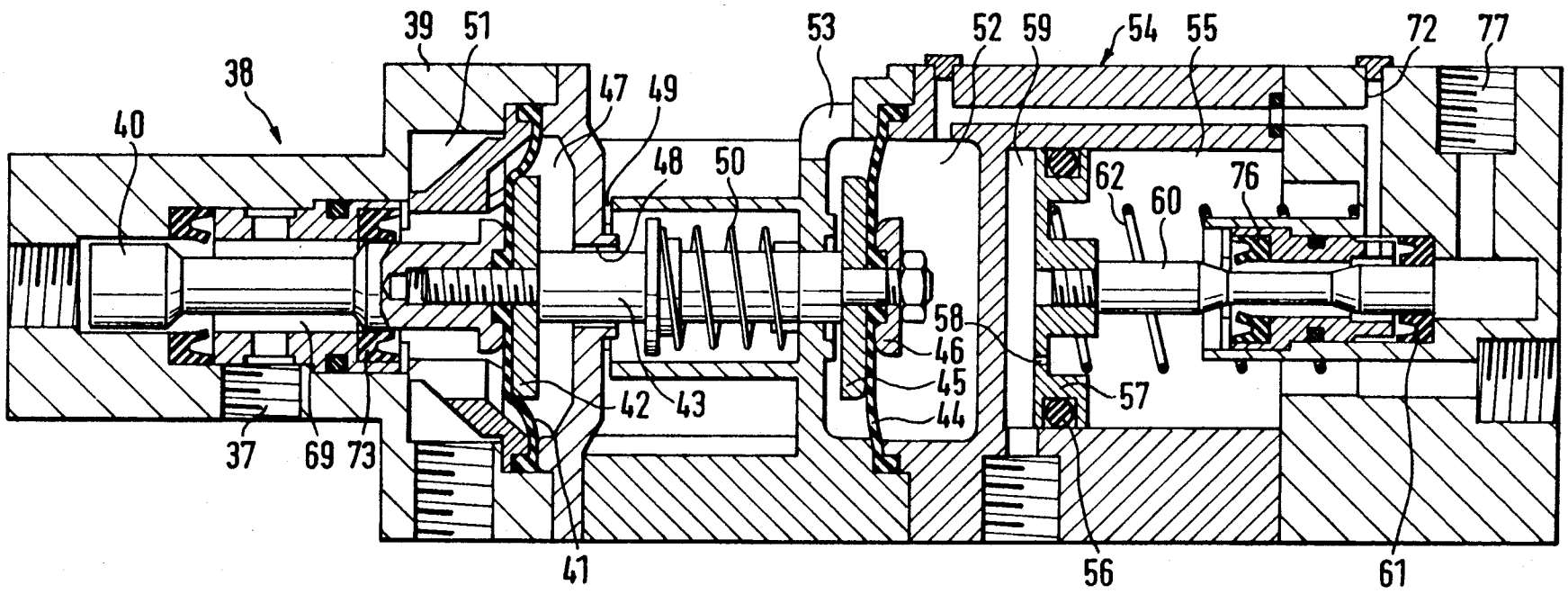
FIG. 3 is an enlarged representation of the control means.

In the shut-off position shown in FIG. 3 the spool valve 57 is in the lower end position thereof. The spool valve is rigidly connected with a valve piston 60. A seal member 61 seals the spool valve chamber 55 towards the atmosphere in cooperation with the valve piston 60. The spool valve 57 is biased into the position shown in FIG. 3 by means of a compression spring 62.

As best shown in FIG. 1 the lower diaphragm chamber 51 is connected through a line 63 with the inlet, the spool valve chamber is connected through a line 64 with the outlet, the lower spool valve chamber 59 is connected through a line 65 with the space between the plug 9 and the valve 30, the space at the outlet side of the piston valve 40 is connected to the atmosphere through a line 66, the space 67 at the rear side of the valve piston is connected with the athmosphere through a line 68 and the control chamber 69 is connected with the piston-cylinder means 33 through the line 37.

As shown in FIG. 1 bores 70 are provided in the lower-most bottom region of the housing for connecting the interior space of the housing with atmosphere.

In the position shown in FIGS. 1 and 3 the tube separator and correspondingly the plug 9 are in shut-off position. The bore 11 is vented through the bores 70. The inlet connection piece and the outlet connection piece are pressure balanced. The spool valve chamber 55 and the lower spool valve chamber 59 are pressurized through control line 64. A check valve 71 in the line 65 is closed. The spool valve 57 and the valve piston 60 are slowly shifted into the lower end position by means of the compression spring 62 which is prestressed to a pressure of 0.3 bar. As a consequence, the water contained in the lower pressure chamber is slowly displaced through the connection bore 58. Further, in this switching position the pressure of the medium acts upon the upper pressure chamber 52 through a control channel 72.

The upper pressure chamber 52 and the diaphragm chamber 51 are also pressure balanced such that the compression spring 50 which is prestressed to a pressure of 0.55 bar can force the connecting piston 43 and the diaphragm 41 and the piston valve 40 connected thereto into the end position shown in FIGS. 1 and 3. A seal member 73 closes the diaphragm chamber 51 in connection with the piston valve 40. The control input 37 is connected with the relief bore which is connected to the line 66. The control line 37 is depressurized such that the compression spring 36 forces the piston 34 and the rack 35 connected thereto into the end position shown in FIG. 1. The plug is turned into the shut-off position through the gearing and the connection shaft 15.

Figure 4:
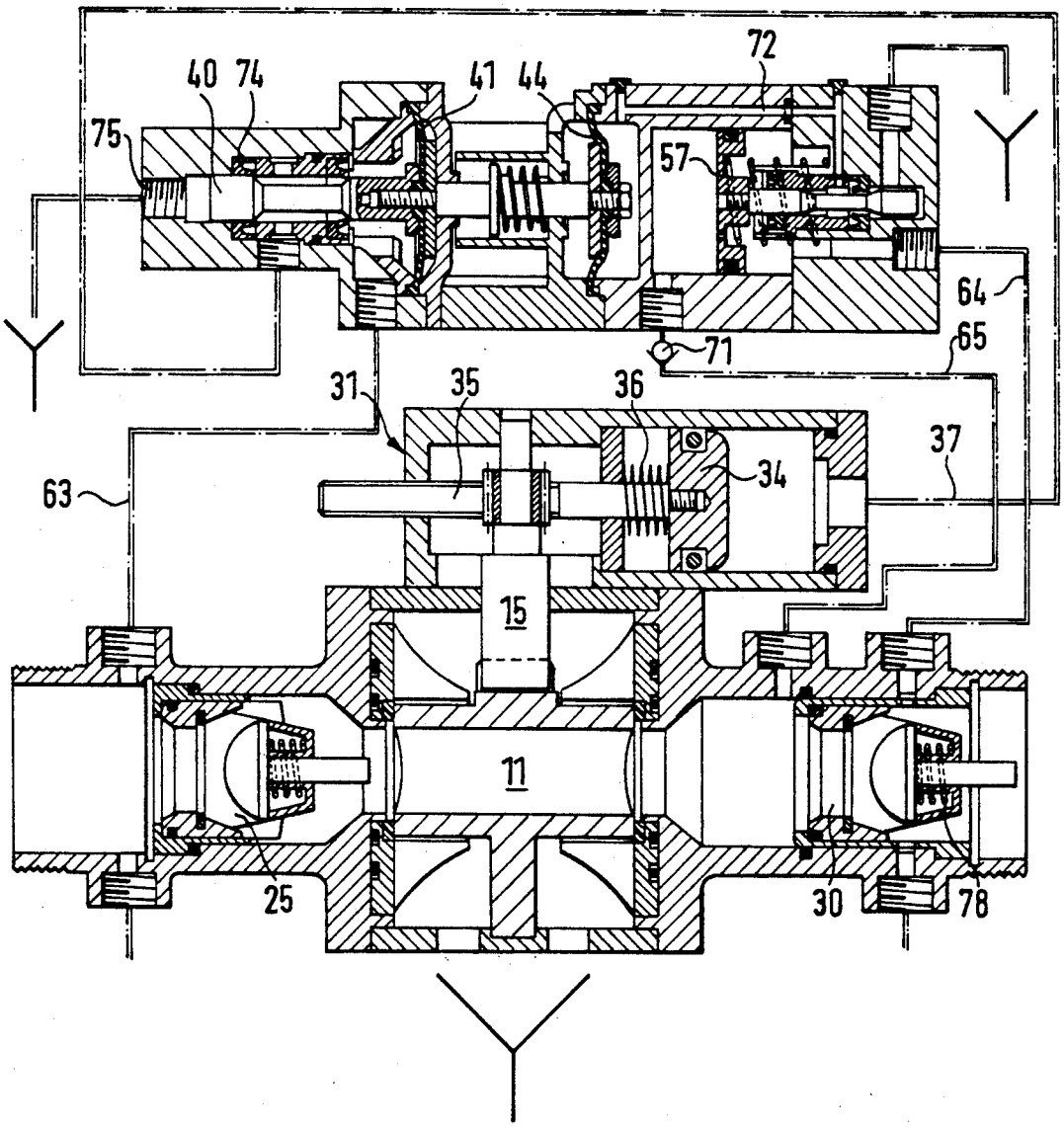
FIG. 4 is a sectional view of the tube separator in open position.

If the water pressure drops at the outlet connection piece 3 for example due to the withdrawal of water, the tube separator is switched into its open or throughflow position. As a consequence of the pressure drop downstream of valve 30 there is also a pressure drop within the upper pressure chamber 52 which is connected with the spool valve chamber 55 through the control channel 72 and with the control line 64. The medium pressure at the inlet connection piece, which is at least 0.45 bar higher, forces the diaphragms 41 and 44, the piston valve 40 and the connecting piston 43 into the end position shown in FIG. 4 against the action of the compression spring 50 which is prestressed to a pressure of 0.55 bar. A seal member 74 closes the relief bore 75 in cooperation with the piston valve 40. A connection between the control input connected to the line 63 and the control input connected with the line 37 is obtained and the gearing unit is pressurized through the control line 37. As a consequence, the piston 34 and thus the rack 35 are forced into the end position shown in FIG. 4 against the action of a compression spring 36, and the plug 9 is rotated by 90° through the gearing and the driving shaft 15 into the open position shown in FIGS. 2 and 4. As a consequence of this opening, the inlet valve 25 opens, whereby the medium flows through the intermediate pressure zone to the outlet valve 30. The spool valve chamber 55 is pressurized through the control line 65 and the throttle bore. Hence, the check valve 71 opens. An adjustable flow throttle can be used in place of the throttle bore.

Because of the increased pressure difference between the upper and the lower spool valve chamber the spool valve 57 and the valve piston 60 are urged in direction against the action of a spring 62. A seal member 76 closes the spool valve chamber 55 in cooperation with the valve piston 60 whereby a connection with a relief bore 77 connected to atmosphere is obtained. The upper pressure chamber 52 is depressurized towards the atmosphere through the control channel 72 such that the tube separator remains in the open position shown in FIGS. 2 and 4. If the flow rate is higher than 30 liter per hour, the outlet valve 30 having a spring 78 which is prestressed by a pressure of about 0.2 bar with respect to the spring 62, opens as well.

In order to keep the tube separator in the stable operating position thereof even at flow rates of less than 30 liter per hour and the corresponding pressure fluctuations, the actuating unit 54 is formed as a time delay member. At flow rates below 30 liter per hour a bypass is opened through the control line 65, the connection bore 58 and the control ine 64 which holds the tube separator in a stable operating position.

Figure 6A:
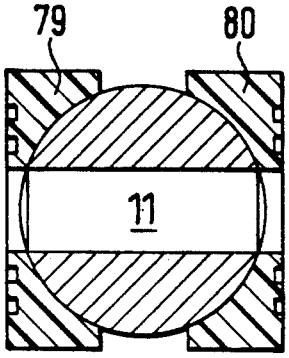
FIG. 6 shows a detail of the embodiment of FIG. 5 in three positions.
Figure 6B:
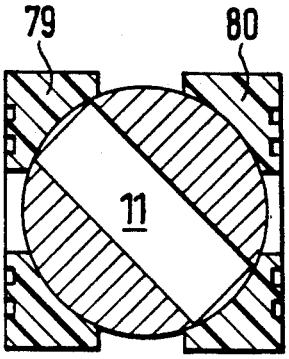
Figure 6C:
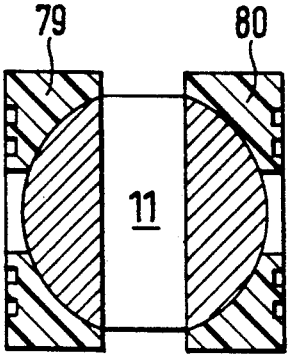
Figure 5:
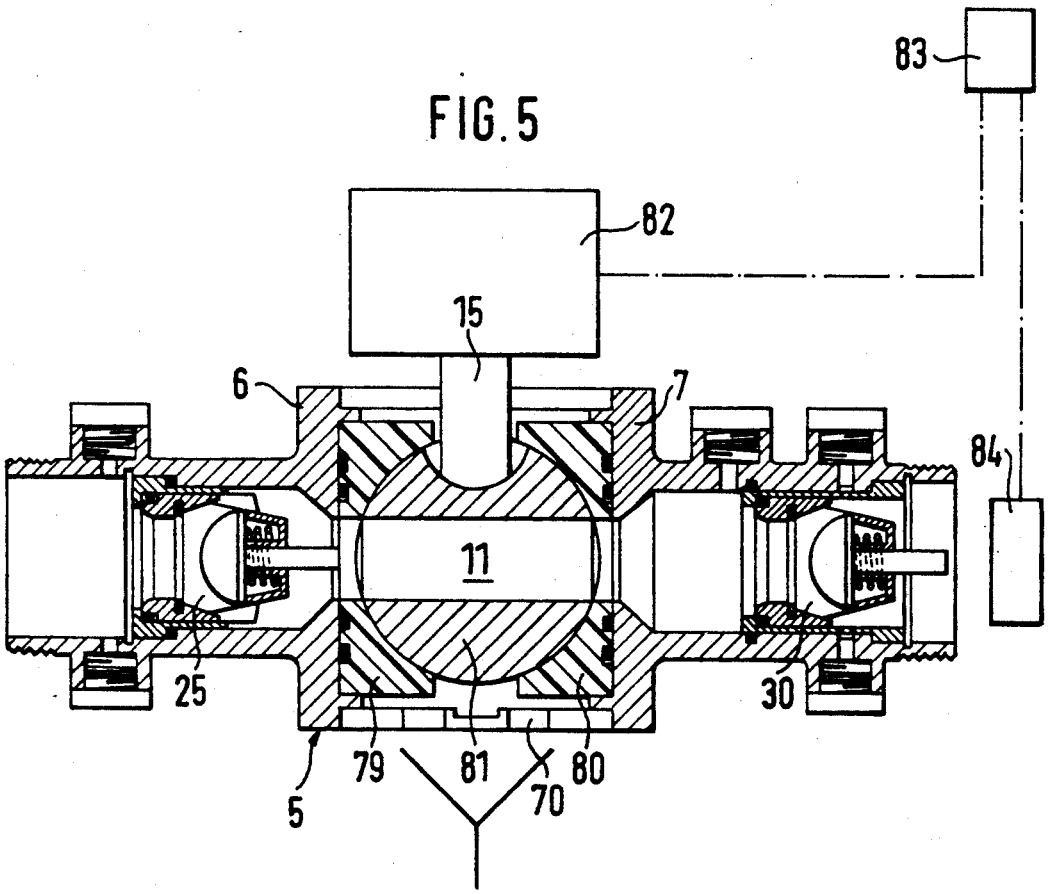
FIG. 5 is a sectional view of a modified embodiment.

The embodiment shown in FIG. 5 differs from the previous embodiment in that the plug valve is replaced by a ball valve. The ball valve has two cylinder disks 79, 80 which are disposed in between the flanges 6, 7 and have their inner faces shaped as hollow spheres symmetrically to the center of the ball valve for receiving the spherical valve body 81. Preferably the cylinder disks are manufactured from PTFE to provide a proper seal. The sphere 81 is connected with the drive shaft 15 which is driven through a gearing unit in the above-described manner. The cylinder disks and the sphere are adapted to be connected with the inlet connection piece and the outlet connection piece in the manner shown in FIG. 6*a* and with the interior of the housing 5 and thus through the bore 70 with the atmosphere in the manner shown in FIG. 6*c*. In the 45° position shown in FIG. 6*b* the bore 11 is tightly sealed and the inlet and the outlet are hermetically separated.

In the embodiment shown in FIG. 5 the above described gearing unit and control unit are replaced by an electric drive 82 with an electric control unit 83. The outlet pressure is sensed by a sensor 84 and a corresponding value is supplied to the control unit 83. The tube separator is opened and closed as a function of the prevailing pressures.

Figure 7:
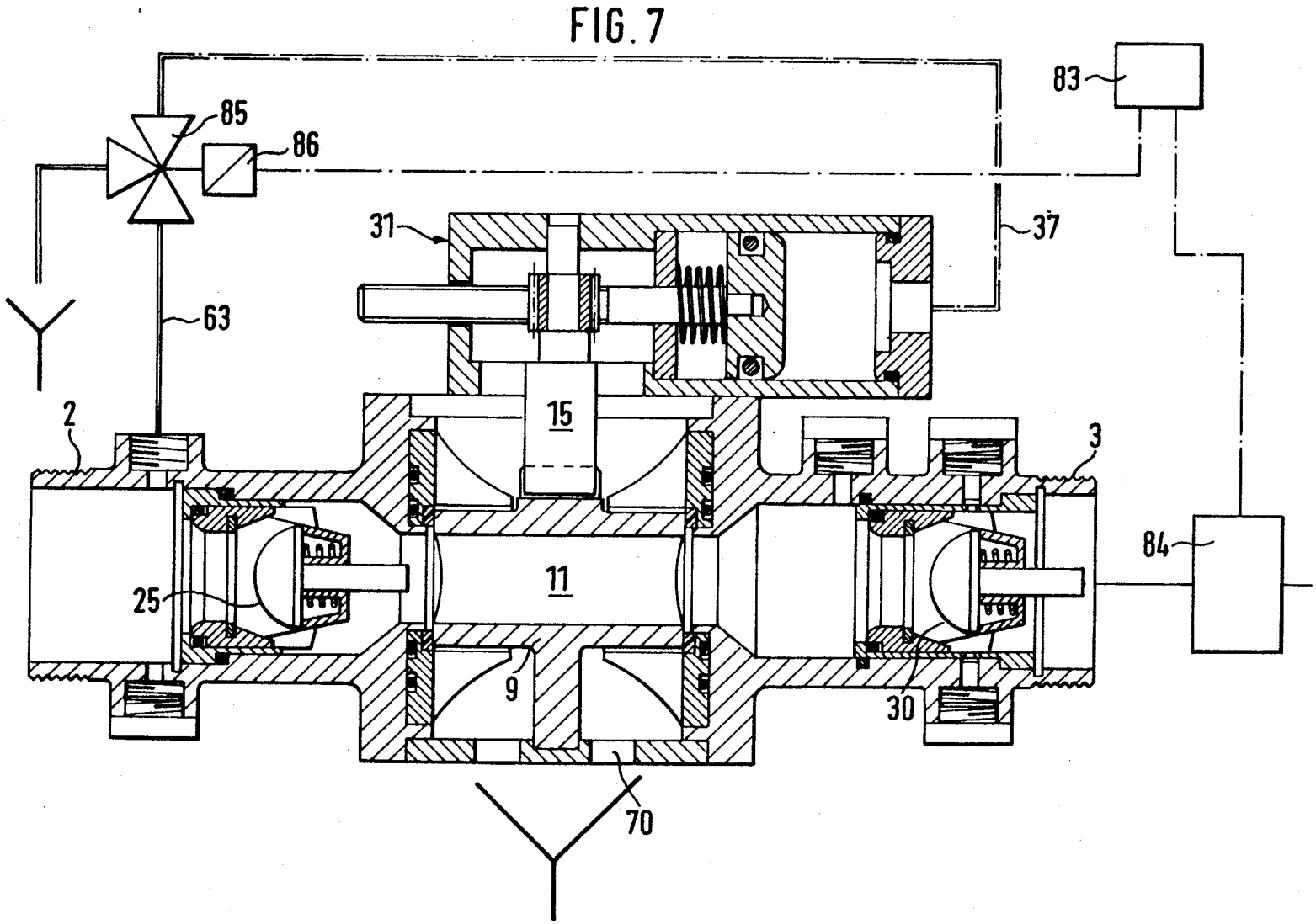
FIG. 7 is a sectional view of a further embodiment.

The embodiment shown in FIG. 7 differs from that of FIG. 1 in that the pneumatic control unit 38, 54 is replaced by an electronic control unit including a three-way valve 85 and a control device 86 which is controlled by the control unit 83.

Figure 8:
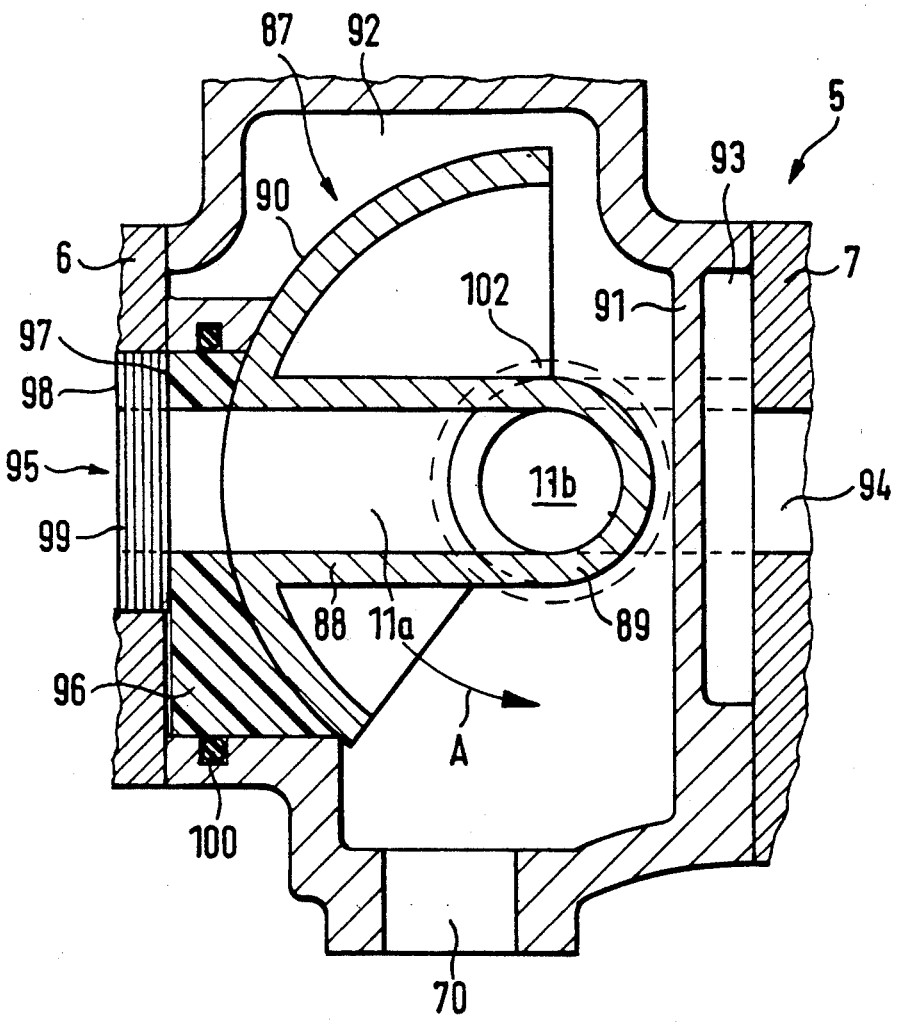
FIG. 8 is a sectional view of the vertical center plane of a further embodiment.
Figure 9:
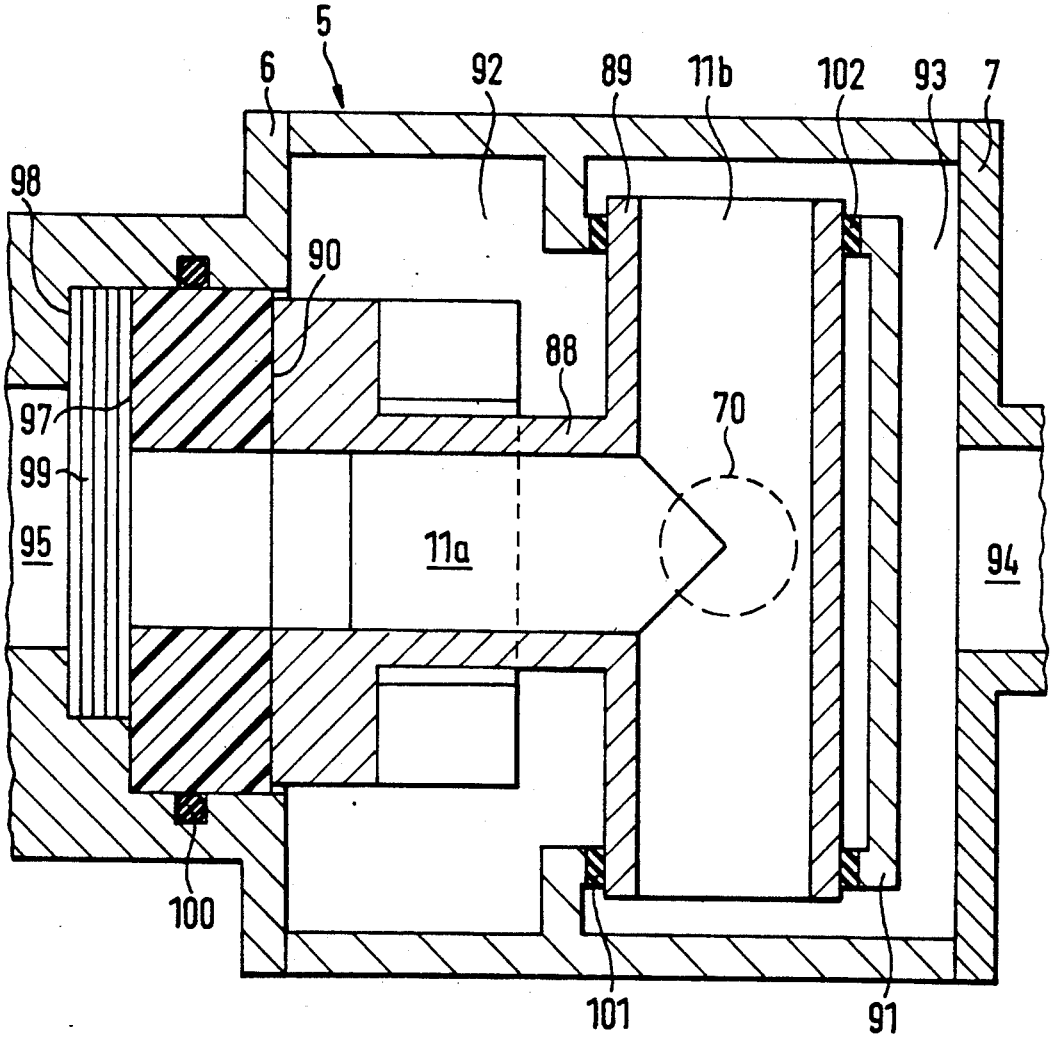
FIG. 9 is a sectional view in the horizontal center plane of the same embodiment.
Figure 10:
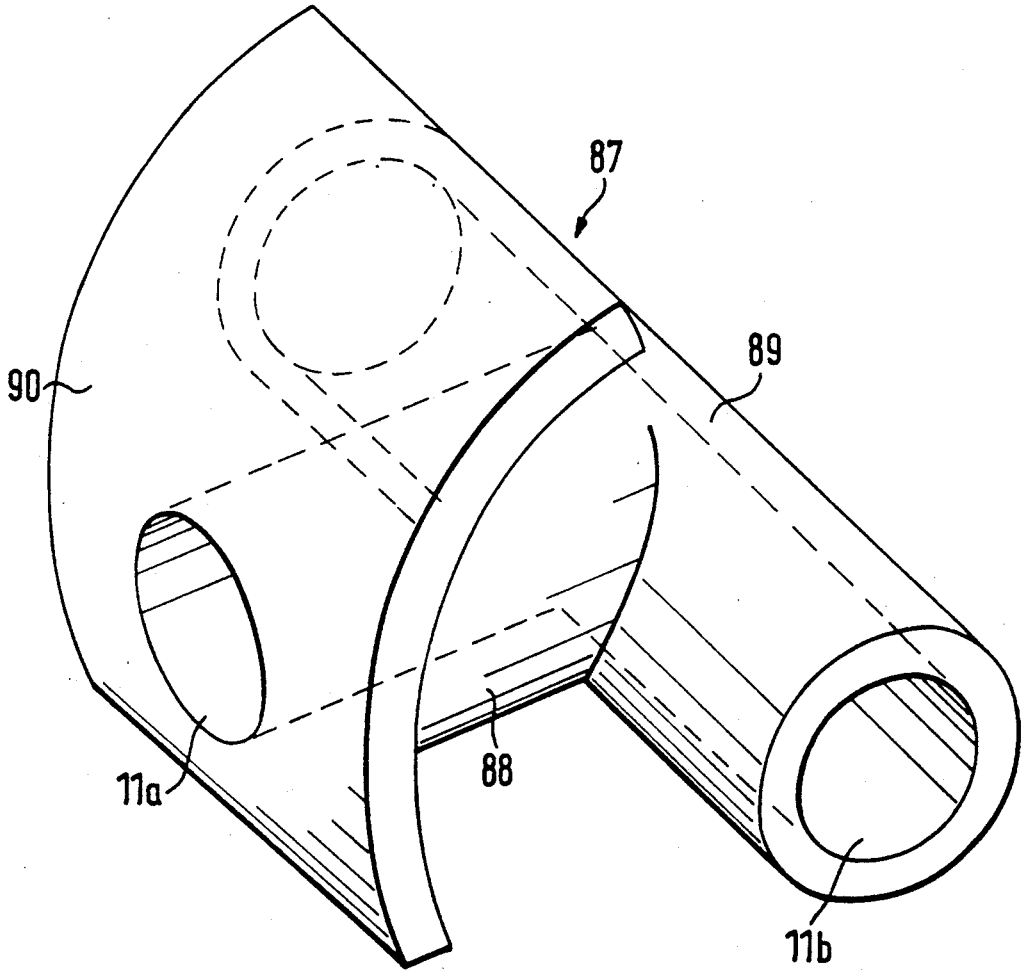
FIG. 10 is a perspective representation of the shut-off member used in this embodiment.

In the further embodiment of the tube separator shown in FIGS. 8 to 10 a shut-off member 87 having the basic shape of a cylinder segment with T-shaped throughbores is arranged in the housing 5. This design allows a reduction of the size and the weight, as compared to the "cylindrical" plug valve used in the embodiment of FIGS. 1 and 2, in particular in use of the tube separator for large diameter tubings.

The shut-off member 87 comprises two legs 88 and 89 each having a bore 11*a* and 11*b*, resp. The first leg 88 is mounted to the center of the second leg 89 at a right angle such that the center axes of both bores intersect and the bores are connected with each other. At the end of the first leg 88 opposite to the second leg 89 a convex cylinder segment surface 90 is formed coaxial with the center axis of the bore 11*b* with the bore 11*a* of the first leg extending therethrough. The form of the shut-off member is best shown in FIG. 10.

In this embodiment there is also an inlet flange 6 and an outlet flange 7 provided at the housing 5.

At the inlet of the housing 5 there is a circular sealing member 96 which surrounds the inlet and has a bore which is coaxial with the center axis of the inlet. The one face 97 of the seal member 96 abuts a disk spring 99 which rests on a shoulder 98 formed at the inlet within the flange 6. The other face of the seal member 96 is formed to correspond in the manner of a negative mould to the shape of the cylinder segment surface 90 of the shut-off member 87 and is forced by the disk spring 99 against the cylinder segment surface 90. An O-ring seal 100 is arranged around the seal member 96.

By cooperation of the seal members and the cylinder segment surface the housing 5 is tightly sealed towards the inlet 95 and flow of liquid out through the bore 70 is prevented.

As best shown in FIG. 9, an interior wall 91 divides the housing 5 into two mutually sealed chambers 92 and 93.

The first chamber 92 at the inlet side surrounds—with the exception of both ends of the leg 89—the shut-off member 87. The shut-off member 87 is mounted within the housing 5 such that the leg 89 extends horizontally and perpendicularly to the line connecting the outlet 94 and the inlet 95 of the housing and that the cylinder segment surface 90 faces the inlet 95. A bore 70 is provided in the lowermost bottom region of the first chamber 92 for connection to the atmosphere.

The second chamber 93 at the outlet side is in permanent connection with both ends of the bore 11*b* and therethrough also with bore 11*a*, and further in permanent connection with the outlet 94 of the housing 5.

The chambers 92 and 93 are mutually sealed by seals 101 and 102 surrounding the ends of the leg 89 passing through the interior wall 91.

In the open position of the shut-off member shown in FIG. 8 the bore 11*a* extends horizontally within the housing 5 such that a connection is provided from the inlet 95 to the outlet 94 of the housing 5 through the bore 11*a*, the bore 11*b* and a chamber 93 for allowing an unrestricted passage of liquid through the housing. The shut-off member 87 is rotatable in counterclockwise direction around the center axis of the bore 11*b* in the manner indicated by the arrow A from the open position shown in FIG. 8 into a shut-off position in which the inlet end of the bore 11*a* opens into the lower region of the first chamber 92 and the inlet is closed by the cylinder segment surface 90 to break the liquid flow towards the outlet.

In this shut-off position of the shut-off member the chamber 92 is therefore connected with the bore 11*a* and therethrough also with bore 11*b* of the shut-off member 87 as well as with the chamber 93 and the outlet 94.

Hence, in the shut-off position of the shut-off member the chamber 93 is connected to atmosphere through the bore 70 in the first chamber 92.

Hence, the liquid within the bores and chambers can flow out through the aperture 70 and the entire housing can be vented.

Although the invention has been described with reference to specific example embodiments, it is to be understood that it is intended to cover all modifications and equivalents within the scope of the appended claims.

What is claimed is:

1. A tube separator comprising an inlet and an outlet to define a flow direction from said inlet to said outlet, shut-off means arranged between said inlet and said outlet, comprising a housing having an interior and a bore connecting the said interior with atmosphere, a shut-off member being arranged within said shut-off means for rotation around an axis perpendicular to said flow direction from a first rotational positions to a second rotational position thereof, the said shut-off member comprises a bore for connecting said inlet with said outlet in said first rotational position and for disconnecting said inlet from said outlet in said second rotational position in which second position the bore of said shut-off member is connected with the interior of said housing of said shut-off means and through the bore of said housing with the atmosphere, control means for operating said shut-off means and a non-return valve at said outlet for blocking or allowing fluid flow from said inlet to said outlet.

2. The tube separator of claim 1, wherein said shut-off member is formed as a plug of a cock.

3. The tube separator of claim 1, wherein said shut-off member is formed as a ball member.

4. The tube separator of claim 1, wherein said shut-off member comprises a journal extending in the direction of the axis of rotation of said shut-off member for supporting said shut-off member in said housing.

5. The tube separator of claim 1, comprising a valve provided at the inlet of said tube separator and operating to block or clear the fluid flow from said inlet to said outlet in respective open and closed positions thereof.

* * * * *